United States Patent [19]

Satoh et al.

[11] 4,284,441

[45] Aug. 18, 1981

[54] METHOD FOR IMPROVEMENT OF MAGNETIC PROPERTY OF THIN STRIP OF AMORPHOUS ALLOY

[75] Inventors: Takehiko Satoh, Musashino; Sonoko Tsukahara; Tachiro Tsushima, both of Tokyo, all of Japan

[73] Assignees: Agency of Industrial Science & Technology; Ministry of International Trade & Industry, both of Tokyo, Japan

[21] Appl. No.: 125,693

[22] Filed: Feb. 28, 1980

[30] Foreign Application Priority Data

Mar. 1, 1979 [JP] Japan ..... 54-22523

[51] Int. Cl.[3] ..... H01F 1/00

[52] U.S. Cl. ..... 148/120; 148/111

[58] Field of Search ..... 148/120, 111

[56] References Cited

U.S. PATENT DOCUMENTS 4,053,331 10/1977 Graham et al. ..... 148/120

4,053,333 10/1977 Egami et al. ..... 148/120

*Primary Examiner*—G. Ozaki

*Attorney, Agent, or Firm*—Kurt Kelman

[57] ABSTRACT

The magnetic properties of a thin strip of amorphous alloy are improved by imparting external stress such as tensile force and compressive force as by means of rollers to the surfaces of the thin strip of alloy while keeping the thin strip heated at a temperature which does not impair the mechanical properties of the amorphous alloy, thereby eliminating the internal stress of the alloy which tends to impair the magnetic properties.

6 Claims, 5 Drawing Figures

METHOD FOR IMPROVEMENT OF MAGNETIC PROPERTY OF THIN STRIP OF AMORPHOUS ALLOY

BACKGROUND OF THE INVENTION

This invention relates to a method for improving the magnetic property of a thin strip of amorphous alloy.

In recent years, remarkable efforts have gone into research toward for the materialization of amorphous metals excelling in mechanical properties such as strength and toughness, chemical properties such as resistance to corrosion, and magnetic properties such as saturation flux density and permeability.

Such amorphous metals are applied to iron cores in transformers of high efficiency for the purpose of taking full advantage of their outstanding magnetic properties. Especially, good promise for future application is shown by materials for magnetic heads to which these amorphous metals are applied with a view to making the most of their high resistance to wear as well as their outstanding magnetic properties. The amorphous metal is produced by fusing a certain genus of metals and/or semimetals compounded at a prescribed proportion of concentrations and cooling the fused mass at a high rate of speed so that the composition does not undergo crystallization. Specifically, a certain method which is generally adopted effects continuous production of the amorphous metal by the steps of reducing to a fused state a mixture using transition metal and noble metal elements such as Fe, Co, Ni, Pb and Au as principal ingredients and additionally incorporating therein semimetals such as B, C, Si and P in a critical proportion of concentrations, spurting the fused mixture onto the rotating surface of a rotary cooling member and thereby allowing the spurted mixture to cool and solidify rapidly. There have been proposed many measures for further improving the outstanding properties of such amorphous alloys. Particularly in the case of amorphous alloys of the kind formulated as magnetic materials for use in magnetic heads and magnetic circuits, there have been proposed a technique (Japanese Patent Disclosure No. 103924/1978) which aims to preclude the thermal deterioration of initial permeability, a phenomenon which the conventional amorphous alloy is designed to undergo upon exposure to heating even at a relatively low temperature, by fixing the concentrations of the component metals thereof within a specific proportion and a technique (Japanese Patent Disclosure No. 43028/1978) which aims to improve the effective permeability of the amorphous alloy by re-heating the alloy up to a temperature falling within a specific range and cooling the heated alloy at a specific rate of temperature decrease.

There has also been proposed a technique (Japanese Patent Publication No. 37133/1975) which, for the purpose of minimizing the phenomenon of magnetic aging (deterioration of magnetic properties with lapse of time) occurring not on amorphous metals but on ordinary steels used as magnetic materials, gives an over-aging treatment to steel plates by imparting stress thereto. As may be inferred from the nature of these techniques, in such crystalline alloys, even if magnetic aging can slightly be restrained, magnetic aging cannot perfectly be eliminated. Still less is it possible to improve the magnetic properties. In fact, such impartment of stress to crystalline alloys encourages occurrence of internal strain and brings about a decline in magnetic properties.

As the result of much research, the inventors have ascertained that an amorphous alloy which is produced in the shape of a thin strip by rapid cooling on the cooling roller produces powerful internal stress and that this internal stress constitutes itself the principal cause for the heavy deterioration in magnetic properties, particularly the property to permit ready magnetization and demagnetization (soft magnetic property). For example, they delivered a paper on the results of their study on the distribution of internal stress present in thin strips of amorphous alloys produced by the quick-cooling method and on the effects of such internal stress upon the magnetic properties at the Scientific Lecture Meeting held on Sept. 20, 1978 by Japan Applied Magnetism Society and at the National Meeting held on Oct. 4, 1978 by Japan Metallurgical Society.

There has been proposed a method for relieving amorphous metals of the internal stress generally liable to impair the soft magnetism by subjecting the amorphous metals to a prolonged thermal treatment at a temperature high enough to effect elimination of the internal stress. The heat treatment continued for a long time at the elevated temperature promotes the embrittlement of the amorphous metals and eventually notably impairs the outstanding mechanical properties owned inherently thereby.

In an effort to improve the magnetic properties of amorphous alloys, strict selection of specific concentrations of component metals in such alloys has been encouraged. Measures proposed in this respect may be roughly grouped under the following two general methods.

(1) Method which comprises subjecting the alloy to a thermal treatment performed at a temperature close to the crystallization transition point for a relatively short period ranging from some tens of minutes to several hours or at a temperature amply lower than the crystallization transition point for a very long period.

(2) Method which comprises combining the treatment of (1) with cooling in the magnetic field.

Because of the high temperatures used for the thermal treatments, these methods deteriorate the mechanical properties of the amorphous alloys and expose such alloys to the thermal treatments for very long periods. Owing to the various disadvantages mentioned above, need has been acutely felt for the development of a novel technique capable of imparting outstanding magnetic properties to amorphous alloys.

An object of this invention is to provide a method for improving the magnetic properties of an amorphous alloy simple by combining the effects of a thermal treatment and the effects of a proper external stress, thereby lowering the temperature used for the thermal treatment, avoiding deterioration of mechanical properties and shortening the period of the thermal treatment.

SUMMARY OF THE INVENTION

To accomplish the object described above according to the present invention, there is provided a method for improving magnetic properties of a thin strip of amorphous alloy, which comprises causing the thin strip of amorphous alloy, while under application of heat, to be alternately bent toward one surface and then the other, the amount of bending and the radii of curvature of the bending be substantially equal for the two surfaces, to impart tensile force and compressive force to the thin strip thereby inducing alleviation of internal stress in the thin strip and enhancing the magnetic properties of the thin strip.

The treatment involved in the method of this invention is based on the discovery that the soft magnetic property can be improved when the internal stress of the thin strip of amorphous alloy is alleviated by alternately imparting tensile force and compressive force to the thin strip while the thin strip is kept heated at a temperature within the range in which no deterioration of mechanical properties is induced. The alternate impartment of tensile force and compressive force to the thin strip of amorphous alloy can be advantageously accomplished by causing the thin strip to be moved on a roller having a fixed radius of curvature or to zigzag around at least one pair of rollers while the heating temperature is kept in the range in which no deterioration of mechanical properties occurs.

The other objects and characteristics of the present invention will become apparent from the further disclosure of the invention which is given hereinafter with reference to the accompanying drawing.

DESCRIPTION OF THE PREFERRED EMBODIMENT

This invention relates to a method for improving the magnetic properties of a thin strip of amorphous alloy produced by the rapid-cooling method.

The preferred embodiments to be described herein are based on the phenomena brought to light by numerous studies conducted by the inventors. Especially for the improvement of the soft magnetic property of the thin strip of amorphous alloy, it suffices to alleviate the internal stress of the thin strip by alternate application of tensile force and compressive force to the thin strip. Further, the alleviation of the internal stress is promoted by carrying out the alternate application of tensile force and compressive force under application of heat at a temperature within the range in which no deterioration of mechanical properties occurs. The promoted alleviation of the internal stress results in the desired improvement of magnetic properties.

Figure 1:
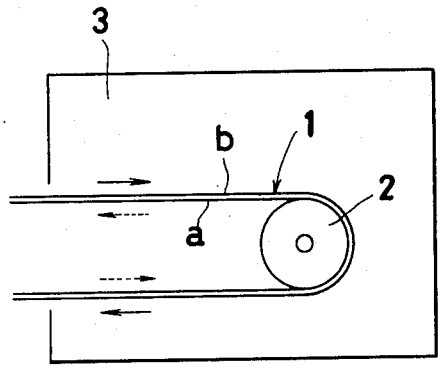
FIG. 1 is a schematic explanatory diagram illustrating the principle of elimination of the internal stress from the thin strip of amorphous alloy according to the method of this invention.
Figure 2:
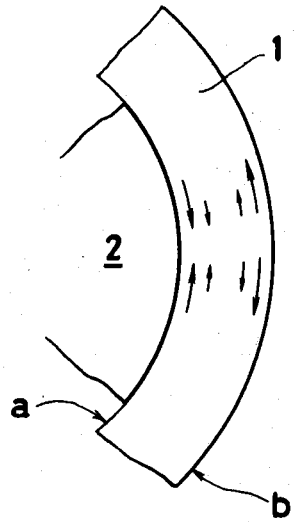
FIG. 2 represents an enlarged view of a portion of the thin strip of FIG. 1, for illustrating the condition in which stress develops.

The principle of the present invention is shown in FIG. 1 and FIG. 2. As illustrated in FIG. 1, when the thin strip 1 of amorphous alloy is moved on a roller 2 having a fixed radius of curvature (the reciprocal of the radius), compressive force is imparted to one surface portion a of the thin strip and tensile force to the other surface b of the thin strip where the thin strip is held in intimate contact with the roller 2 as shown in FIG. 2. The compressive force and tensile force thus imparted increase in the direction of the surfaces of the surface portions a, b. By subsequently bringing the opposite surface of the thin strip into contact with another roller of an identical radius of curvature, compressive force can now be imparted to the surface portion b and tensile force to the surface portion a of the thin strip. The present invention performs this operation at least once each on the surface portions a, b of the thin strip while the thin strip is kept in a heated state. The number of times that these operations are desirably performed on each surface portion is determined, in accordance with the kind of thin strip, within the range in which possible deterioration of mechanical properties by fatigue does not become conspicuous. The conditions such as the diameter of the rollers, the range of heating temperature and the travelling speed of the thin strip are determined by the composition of the amorphous alloy, the thickness of the thin strip and the condition of the manufacture of amorphous alloy. For the class of amorphous alloy materials known to the art, the diameter of the rollers will be not more than 600 mm and the temperature range will be from 100° to 500° C. The application of heat to the thin strip during the treatment can be suitably carried out as by performing the treatment within a heating room 3 kept at a temperature within the aforementioned range or by keeping the rollers at a temperature within the aforementioned range by means of heaters incorporated one each within the rollers. Further, the internal stress of the thin strip of the amorphous alloy can be alleviated merely by moving the thin strip at least once on the roller 2 in such a manner that the surface opposite to the surface which came into contact with the cooling roller for producing the amorphous alloy, is held in contact with the roller 2 as shown in FIG. 1. Moreover, a magnetic iron core having good magnetic properties can be manufactured by rolling the thin strip thus treated into a core in such a way that the inside surface of the core is the surface opposite to the surface which came into contact with the cooling roller in producing the amorphous alloy.

Figure 3:
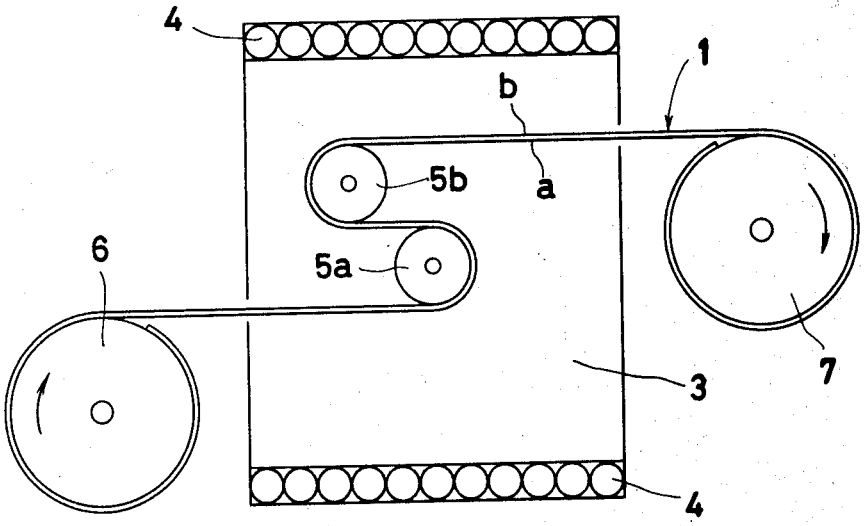
FIG. 3 is a schematic explanatory diagram illustrating one preferred embodiment of the method of this invention.

FIG. 3 illustrates one preferred embodiment of the apparatus to be used for working the present invention. Within a furnace or heating chamber 3 heated by an electric furnace 4, one pair of rollers 5*a*, 5*b* of an identical diameter are disposed and a thin strip 1 is passed zigzag round the two rollers. When the thin strip is passed on the rollers, the roller 5*a* imparts compressive force and the roller 5*b* tensile force respectively to the surface portion a of the thin strip and, on the other hand, the roller 5*a* imparts tensile force and the roller 5*b* compressive force respectively to the other surface portion b. Where the thin strip 1 is passed just once on the rollers 5*a*, 5*b*, the winding bobbin 7 is required to have a diameter greater than the diameter of the rollers. Where the thin strip 1 is passed back and forth once or more on the rollers 5*a*, 5*b*, the bobbins 6, 7 are both required to have a greater diameter than the diameter of the rollers. This is because the radius of curvature of the bobbin is desired to be decreased as much as possible for the purpose of preventing compressive strength and tensile strength from being imparted appreciably to the thin strip 1 while the thin strip is being taken up on the bobbin. As an inevitable consequence, the rollers 5*a*, 5*b* which impart compressive strength and tensile strength are required to have a smaller diameter than the bobbins 6, 7.

Figure 4:
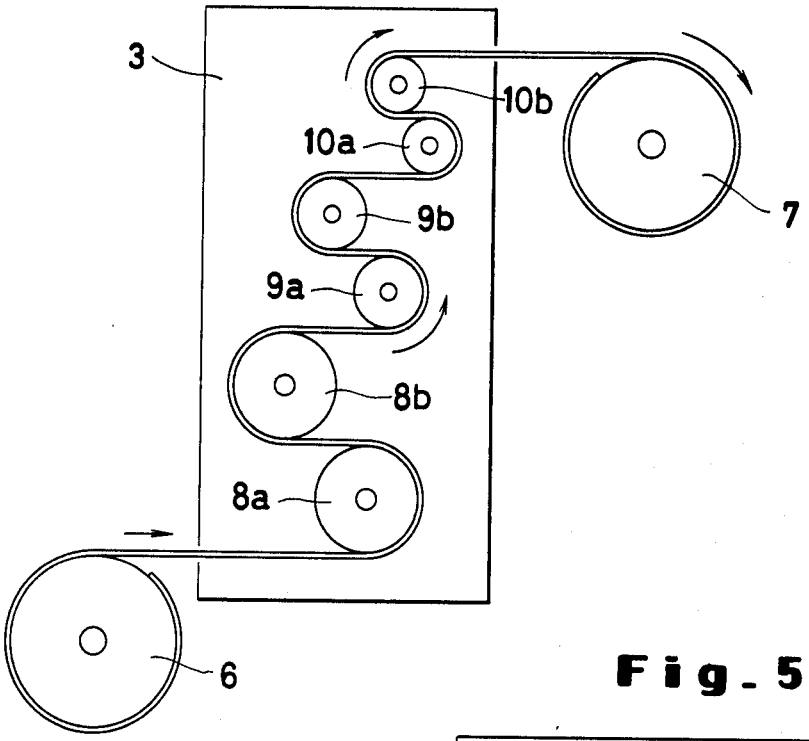
FIG. 4 is a schematic explanatory diagram illustrating another preferred embodiment of the method of this invention.
Figure 5:
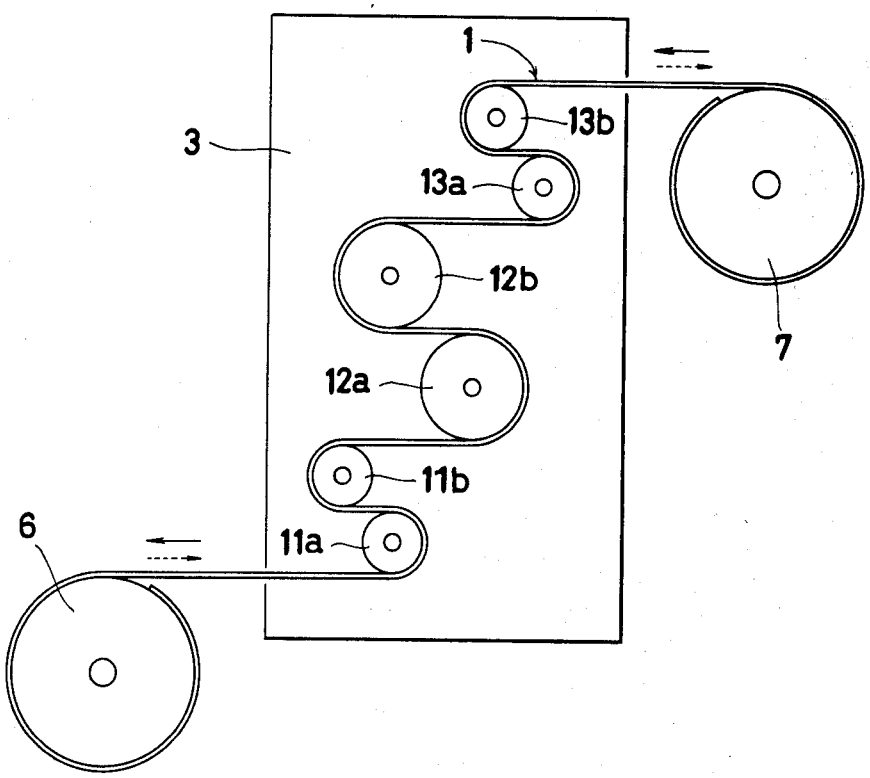
FIG. 5 is a schematic explanatory diagram illustrating yet another preferred embodiment of the method of this invention.

The number of rollers to be used herein need not be limited to just one pair. A plurality of pairs of rollers may be disposed and the thin strip 1 can be passed just once in one direction on all the rollers or it can be passed back and forth on all the rollers. Where a plurality of pairs of rollers are disposed and the thin strip is passed just once in one direction on all the rollers, the pairs of rollers 8*a*, 8*b*, 9*a*, 9*b* and 10*a*, 10*b* are given successively smaller diameters in the direction of the travel of the thin strip as illustrated in FIG. 4 instead of being given one identical diameter. In this arrangement, the magnitudes of external stress imparted to the thin strip by the pairs of rollers can be increased successively in the direction of the travel of the thin strip. Thus, this arrangement proves advantageous where abrupt increase of external stress is undesirable. Where the thin strip is such that no restriction is imposed thereon with respect to composition or thickness and the magnetic properties thereof can be improved by application of varied external stress, all the rollers may be given different diameters from one another, or the rollers of the intermediate pair 12*a*, 12*b* may be given a greater diameter than the rollers of the preceding pair 11*a*, 11*b* or those of the following pair 13*a*, 13*b* as illustrated in FIG. 5, or the rollers of the following pair may be given a smaller diameter than those of the preceding pair as described above and the thin strip may be passed back and forth once or more on all the rollers. After passage on all the rollers, the thin strip has already been freed from the internal stress. In order that the thin strip is exposed to no further excessive external stress, the bobbin on which the thin strip is to be taken up is given a diameter greater than the diameter of any of the rollers used for the passage of the thin strip.

Now, the effect of this invention will be described with reference to a working example.

A thin strip of amorphous alloy, as a test piece, having a composition, $Fe_xB_{1-x}$ (x=0.8), and a thickness of 0.06 mm exhibited a maximum permeability of 58,000 and a coercive force of 50 mOe.

(Conventional method) . . . The test piece of the aforementioned thin strip of amorphous metal was treated at 200° C. for 27 hours.

(Comparative method) . . . The same kind of test piece 2000 mm in length was passed back and forth three times for about 20 seconds, in an apparatus of FIG. 3 (using two rollers having a diameter of 25 mm) at room temperature.

(Method of this invention) . . . The same kind of test piece having the same length was passed back and forth three times for the same time in the apparatus of FIG. 3 placed within a furnace compartment kept at 200° C.

The results are shown in the following table.

| | Maximum permeability | Coercive force |
|---|---|---|
| Test piece ($Fe_xB_{1-x}$ (x = 0.8), 0.06mm in thickness) | 58,000 | 50mOe |
| Treatment by the conventional method | 118,000 | 42mOe |
| Treatment by the comparative method | 79,000 | 42mOe |
| Treatment by the present invention | 183,000 | 20mOe |

By the conventional method, the maximum permeability was increased by about 2.0 times and the coercive force was decreased to 84%. Although this conventional method improved the magnetic properties to some extent, it nevertheless entailed the disadvantage that the thermal treatment had to be continued for as long as 27 hours. A decrease in the time for the thermal treatment may possibly be obtained by increasing the temperature of the thermal treatment. If the temperature of the thermal treatment is increased to 350° C. for the purpose of improving the magnetic properties to the same extent as described above, for example, the time for the thermal treatment may be decreased to two hours. In this case, however, the thin strip undergoes the phenomenon of embrittlement because of the high temperature of the treatment. In this respect, therefore, the alloy has its mechanical properties seriously impaired.

When the thin strip was passed on the rollers in the absence of heat application as in the comparative method, the magnetic properties could not be improved to any appreciable extent. When the passage of the thin strip was carried out under application of heat at 200° C., a temperature lower than the crystallization transition point, as in the method of this invention, the maximum permeability was increased by 3.2 times and the coercive force was decreased to 40%. Thus, the magnetic properties were greatly improved and the time for the thermal treatment was notably decreased. This treatment brought about no decline in mechanical properties due to embrittlement.

If the temperature for the thermal treatment is increased from 200° C. to 250° C., for example, for the purpose of heightening the effect of treatment, i.e. the improvement of magnetic properties, without causing any decline of mechanical properties, the test pieces of the same length can be passed back and forth twice for about 15 seconds.

In the case of the amorphous alloy of the composition, $Fe_xB_{1-x}$ (x=0.8), since the crystallization transition point thereof is about 450° C., the temperature for the thermal treatment can suitably be fixed within the range of from about 150° to about 350° C. with due consideration paid to the length of the thermal treatment. In the case of other amorphous alloys of different compositions, the method of this invention can greatly improve the magnetic properties in extremely short periods of time without impairing the mechanical properties when the temperature and time of thermal treatment are suitably fixed with due consideration paid to the range of temperature automatically determined based on the crystallization transition points.

As described above, the present invention accomplishes the improvement of magnetic properties of a given thin strip of amorphous alloy or the elimination of internal stress from the thin strip or both, with the time for the thermal treatment decreased to a great extent and the temperature for the thermal treatment lowered notably. Moreover, the thermal treatment given by the method of this invention does not impair the mechanical properties of the alloy. Thus, the present invention provides method for the manufacture of a thin strip of amorphous alloy of greatly improved properties.

What is claimed is:

1. A method for improving the magnetic properties of a thin strip of amorphous alloy, comprising bending the thin strip of amorphous alloy by means of a roller having a fixed radius of curvature in such a manner that the surface opposite to the surface which came into contact with the cooling roller for producing amorphous alloy to impart tensile force and compressive force to the surfaces at a temperature lower than the crystallization transition point of the alloy, thereby promoting the alleviation of the internal stress present in the thin strip and improving the magnetic properties of the alloy.

2. A method for improving the magnetic properties of a thin strip of amorphous alloy, comprising alternately bending the thin strip of amorphous alloy toward one surface and then the other at equal radii of curvature to impart tensile force and compressive force to the surfaces at a temperature lower than the crystallization transition point of the alloy thereby promoting the alleviation of the internal stress present in the thin strip and improving the magnetic properties of the alloy.

3. The method according to claim 2, wherein the alternate bending of the thin strip at equal radii of curvature and the consequent impartment of tensile force and compressive force to the surfaces are accomplished by causing each surface of the thin strip to be passed once or more over the surface of a roller.

4. The method according to claim 2, wherein the alternate bending of the thin strip at equal radii of curvature and the consequent impartment of tensile force and compressive force to the surfaces are accomplished by zigzagging the thin strip round at least two rollers of equal radius of curvature disposed one behind the other and passing the thin strip one or more times with one surface of the thin strip in contact with one of the rollers and the other surface of the thin strip in contact with the other roller.

5. The method according to any of claims 3 or 4, wherein the diameters of the rollers used for the purpose of imparting tensile force and compressive force to the opposite surfaces of the thin strip are smaller than the diameter of the bobbin used for taking up the thin strip after passage over all the rollers.

6. The method according to claim 4, wherein the thin strip is zigzagged around two successive pairs of rollers of equal radius of curvature, the radii of curvature of the successive pair of rollers used for conveying the thin strip are increased in the direction of the travel of the thin strip thereby increasing the magnitudes of tensile force and compressive force imparted to the thin strip in the same direction.

* * * * *